US008127842B2

(12) United States Patent
Satchell, Jr. et al.

(10) Patent No.: US 8,127,842 B2
(45) Date of Patent: Mar. 6, 2012

(54) BITUMEN PRODUCTION METHOD

(75) Inventors: Donald Prentice Satchell, Jr., Chatham, NJ (US); Stevan Jovanovic, North Plainfield, NJ (US)

(73) Assignee: Linde Aktiengesellschaft, Munich (DE)

( * ) Notice: Subject to any disclaimer, the term of this patent is extended or adjusted under 35 U.S.C. 154(b) by 120 days.

(21) Appl. No.: 12/538,967

(22) Filed: Aug. 11, 2009

(65) Prior Publication Data

US 2010/0200227 A1 Aug. 12, 2010

Related U.S. Application Data

(60) Provisional application No. 61/088,038, filed on Aug. 12, 2008.

(51) Int. Cl.
*E21B 43/243* (2006.01)

(52) U.S. Cl. ..... 166/256

(58) Field of Classification Search ..... None
See application file for complete search history.

(56) References Cited

U.S. PATENT DOCUMENTS

| | | | | |
|---|---|---|---|---|
| 2,359,108 | A | 2/1942 | Hoskins | |
| 3,978,925 | A * | 9/1976 | Redford | 166/261 |
| 4,133,382 | A | 1/1979 | Cram et al. | |
| 4,217,956 | A | 8/1980 | Goss et al. | |
| 4,224,991 | A | 9/1980 | Sowa et al. | |
| 4,344,485 | A | 8/1982 | Butler | |
| 4,410,042 | A | 10/1983 | Shu | |
| 4,454,916 | A | 6/1984 | Shu | |
| 4,557,329 | A | 12/1985 | Savard et al. | |
| 4,722,395 | A | 2/1988 | Venkatesan | |
| 5,027,896 | A | 7/1991 | Anderson | |
| 5,456,315 | A | 10/1995 | Kisman et al. | |
| 6,059,858 | A | 5/2000 | Lin et al. | |
| 6,206,684 | B1 | 3/2001 | Mueggenburg | |
| 6,412,557 | B1 | 7/2002 | Ayasse et al. | |
| 7,303,606 | B2 | 12/2007 | Zeng et al. | |
| 7,338,549 | B2 | 3/2008 | Bulow et al. | |
| 7,493,952 | B2 | 2/2009 | Ayasse | |
| 7,866,389 | B2 * | 1/2011 | De Francesco et al. | 166/272.4 |
| 2006/0243448 | A1 * | 11/2006 | Kresnyak et al. | 166/303 |
| 2007/0266962 | A1 | 11/2007 | Stone et al. | |

FOREIGN PATENT DOCUMENTS

| | | |
|---|---|---|
| CA | 2004352 | 6/1991 |

* cited by examiner

*Primary Examiner* — Angela M DiTrani
(74) *Attorney, Agent, or Firm* — Philip H. Von Neida

(57) ABSTRACT

A method for the production of a $CO_2$ rich stream for sequestration in depleted oil sand reservoirs. The method comprises the steps of: a) purging non-condensable gases from an oil sand reservoir with steam; b) contacting a gaseous oxidant stream comprising oxygen, carbon dioxide, and steam with bitumen in an oil reservoir; c) separating the production well product from the oil sand reservoir into bitumen, water, sand and fuel gas streams; d) producing a carbon dioxide rich gas by combustion of the said fuel gas with substantially pure oxygen; e) utilizing substantially pure oxygen and a portion of said carbon dioxide rich gas as constituents of said gaseous oxidant stream; and f) sequestering a balance of said carbon dioxide rich gas into a depleted oil said reservoir.

10 Claims, 5 Drawing Sheets

BITUMEN PRODUCTION METHOD

This application claims priority from U.S. provisional patent application Ser. No. 61/088,038 filed Aug. 12, 2008.

BACKGROUND OF THE INVENTION

The general field of this invention is the production of heavy oil and bitumen from underground deposits, particularly tar sands deposits. More specifically, this invention relates to a method for bitumen or heavy oil recovery by in situ combustion that substantially decreases carbon dioxide emissions.

There are extensive oil sand reserves in many areas of the world, e.g. Alberta in Canada, Utah, Wyoming, and Colorado in the United States, and Venezuela. However, the very high viscosity of bitumen makes economically viable and environmentally responsible exploitation of these abundant resources very challenging. Conventional oils can be efficiently recovered without any need for heating to reduce their viscosity. Carbon dioxide injection can be used to reduce the viscosity of conventional oil and increase the quantity of oil recovered. However, substantial energy inputs are required to lower the viscosity of very heavy oil or bitumen in order to achieve reasonable production rates. This high energy input requirement increases the bitumen production cost and associated carbon dioxide emissions relative to conventional oil. As a result of the dwindling reserves of conventional oil, there has been a long-standing effort to develop methods to more economically exploit these reserves in an environmentally responsible manner.

Bitumen was initially produced by mining using the 'hot water' method (CA2004352) to extract the hydrocarbons from the mineral gangue. This method has four problems. First, mining requires disturbance of the land. Second, most bitumen reserves are too deep to be economically recovered by mining. Third, this method requires large quantities of scarce water. Fourth, this method has a high energy input requirement, which substantially decreases the net energy production and increases $CO_2$ emissions relative to conventional oil production.

The steam assisted and gravity drainage (SAGD) in situ bitumen production method (U.S. Pat. No. 4,344,485) is currently the most commercially successful method to exploit deeper bitumen reserves. This method uses a horizontal upper steam injection well and lower parallel bitumen production well. Although this method can economically produce bitumen at greater depths than mining, it also requires large quantities of water and energy for steam production. Boilers (US 2007/0266962) with indirect heating are typically used for SAGD steam production, which generally require a premium natural gas fuel and results in significant $CO_2$ emissions. U.S. Pat. No. 4,224,991 teaches an oxygen-fuel combustion method with water injected into the combustion region to control its temperature to produce steam for heavy oil production. In addition, direct contact steam generators can also advantageously use water to control flammability of the premixed $O_2$-fuel feed (U.S. Pat. No. 6,206,684) or to cool the combustion chamber walls (U.S. Pat. No. 2,359,108).

It has long been recognized that in situ combustion bitumen production processes have the potential to solve many of the SAGD process problems by [1] producing, rather than consuming water, [2] using lower value bitumen components as an energy source, rather than an external premium fuel, [3] in situ upgrading of the bitumen, and [4] simplifying the recovery of $CO_2$. In situ combustion processes typically have vertical oxidant injection wells and vertical (U.S. Pat. No. 4,722,395) or horizontal (U.S. Pat. No. 5,456,315) production wells. A wide variety of oxidants have been proposed for in situ production processes: air (U.S. Pat. No. 5,456,315), air-$O_2$ (U.S. Pat. No. 4,557,329), $O_2$-water (U.S. Pat. No. 5,027,896), $O_2$-steam (U.S. Pat. No. 4,133,382), $O_2$—$CO_2$ (U.S. Pat. No. 4,410,042), and $O_2$—$CO_2$— steam (U.S. Pat. No. 4,217,956). Hydrotreating catalyst may be advantageously added to the production well for in situ bitumen upgrading using in situ produced hydrogen (U.S. Pat. No. 6,412,557). There have been modest efforts to utilize the off-gas from in situ combustion bitumen production processes. For example, U.S. Pat. No. 4,454,916 teaches the use of a highly enriched air oxidant ($\geqq$50 volume percent $O_2$) separating carbon dioxide from the off-gas from an in situ heavy oil production process to produce a low heating value fuel gas.

A number of factors make carbon dioxide capture and sequestration from conventional bitumen production processes impractical. First, the gaseous emissions from bitumen production processes invariably have very low carbon dioxide concentrations, typically about 15 molar percent. Second, bitumen production facilities typically have a large number of gaseous emission points. Third, bitumen production facilities have a much shorter economic life than most other large carbon dioxide emission sources like coal fired electrical power generation facilities. Unfortunately, bitumen production processes have high carbon dioxide emission rates. For example, mining and SAGD bitumen production processes have typical carbon dioxide emission rates of about 90 and 60 kilograms per petroleum barrel (kg/bbl) bitumen produced. As a result, carbon dioxide emissions from bitumen production will likely become a significant source of carbon dioxide emissions and have a significant impact on global warming. For example, bitumen production from Canadian oil sands is expected to increase from 1.3 million barrels per day in 2008 to about 4 million barrels per day by 2030. If conventional technology were used to meet this expected increase in market demand, then the associated carbon dioxide emissions should increase by about 60 million metric tons per year by 2030, or about 10% of Canada's 2006 total carbon dioxide emissions. Therefore, there is a clear need for a practical bitumen production method with much lower carbon dioxide emissions that is not met by the prior art.

SUMMARY OF THE INVENTION

The invention is a continuous bitumen in situ production method which comprises the following steps:

a) purging non-condensable gases from the an oil sand reservoir with steam;
b) contacting a gaseous oxidant stream comprising oxygen, carbon dioxide, and steam with bitumen in an oil sand reservoir;
c) separating the production well product from the oil sand reservoir into bitumen, water, sand, and fuel gas streams;
d) producing a carbon dioxide rich gas by combustion of the said fuel gas with substantially pure oxygen;
e) utilizing substantially pure oxygen and a portion of said carbon dioxide rich gas as constituents of said gaseous oxidant stream; and
f) sequestering a supermajority of the balance of the said carbon dioxide rich gas into a depleted oil sand reservoir.

DETAILED DESCRIPTION OF THE INVENTION

Figure 1:
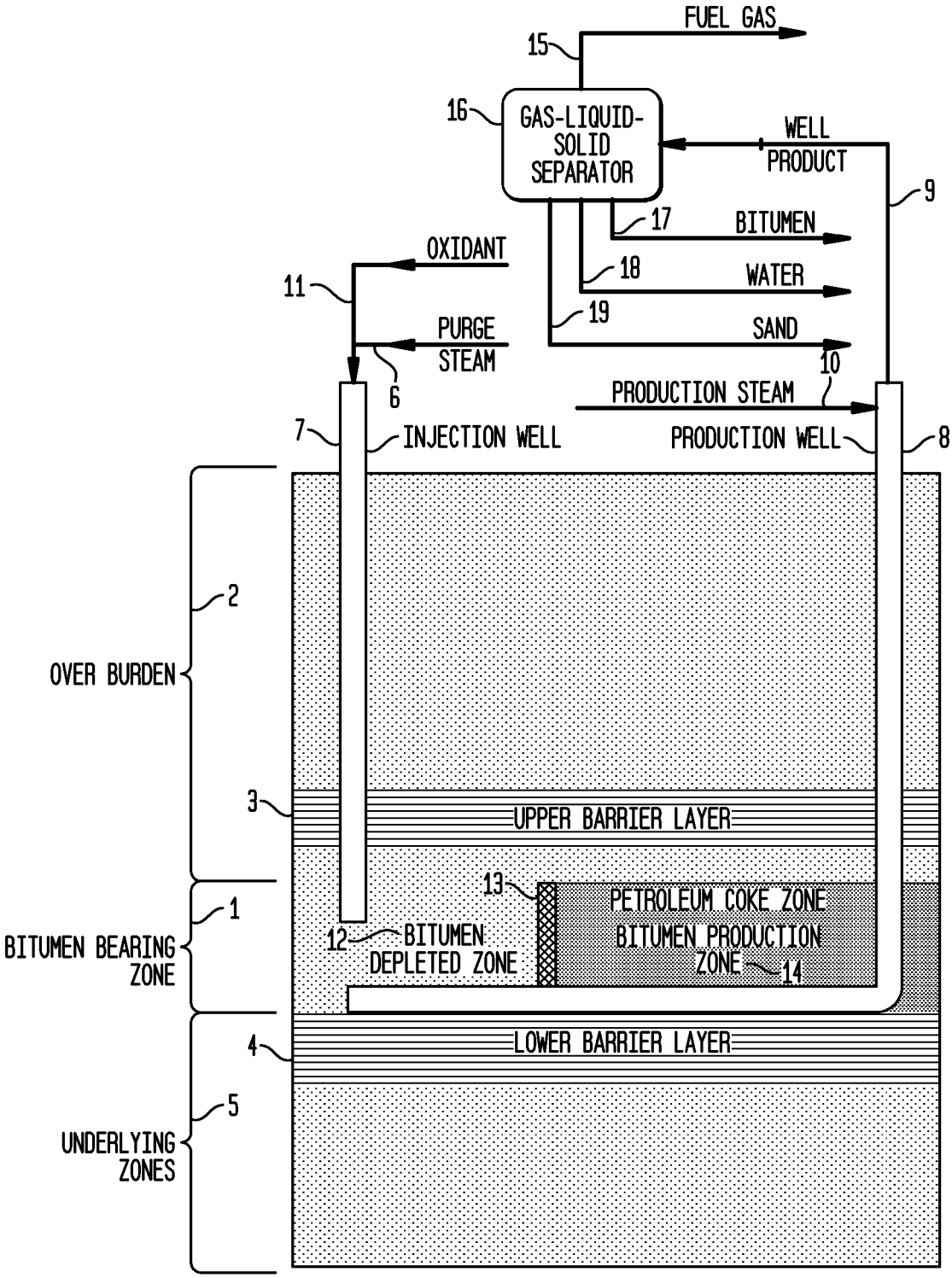
FIG. 1 is a simplified sketch of a well pair in an underground oil sand reservoir.

FIG. 1 is a simplified sketch of an underground oil sand reservoir. These oil sand reservoirs contain bitumen that is a hydrocarbon fuel with a high density (typically greater than 1 kilogram per liter), a high residua content (typically about 50 wt % yield of components with normal boiling points greater than 525° C.), and a high viscosity (typically about 27,000 cPs at 40° C.). The bitumen in the underground oil sand reservoir is generally intimately associated with sand or clay in a bitumen bearing zone 1. The bitumen bearing zone 1 typically occurs below between 50 and 500 meters of over burden 2 and has a thickness between 5 and 50 meters. The gaseous contents of the bitumen bearing zone 1 are typically perlimited by an upper barrier layer 3 somewhere in the over burden 2 and a lower barrier layer 4 somewhere in the underlying zones 5.

FIG. 1 will also be used to illustrate the key features of this continuous bitumen production method. Typically, purge steam 6 is injected into the bitumen bearing zone 1, via an injection well 7, to preheat and purge non-condensable gases, primarily nitrogen, from the bitumen bearing zone 1. This steam flows from the injection well 7, through the bitumen bearing zone 1 to the production well 8 and exits via the well product 9 line. The production well 8 may be a vertical pipe, or preferably, a vertical pipe with a horizontal segment underlying the bitumen production zone 1 as shown in FIG. 1. Production steam 10 may advantageously be used to heat the production well 8 and the region in the vicinity of the production well 8.

For simplicity, FIG. 1 considers the most straightforward case of a single injection well 7 and a single production well 8 pair for the oil sand reservoir. However, typically many injection and production well pairs are utilized in a matrix configuration to increase the rate and amount of bitumen produced from an underground oil sand reservoir. Once the purge steam 6 has displaced the non-condensable gases from the bitumen bearing zone 1, an oxygen containing oxidant 11 is continuously injected into the bitumen bearing zone 1 via the injection well 7. This method is applicable for bitumen production from an underground oil sand reservoir using the continuous flow of an oxidant 11 with any configuration of oxidant injection 7 and production 8 wells. The alternative 'huff and puff' type in situ combustion processes, that alternatively feed the oxidant and collect the product using a single well, is outside the scope of this invention.

This continuous in situ combustion bitumen production method can be envisioned in terms of three regions within the bitumen bearing zone 1: the bitumen depleted zone 12, the petroleum coke zone 13, and the bitumen production zone 14. The continuous in situ bitumen production process will be described in terms of these zones.

The bitumen depleted zone 12 can be visualized as a substantially hydrocarbon free region. The oxygen containing oxidant 11 is fed to the bitumen bearing zone 1 via the injection well 7. The oxidant 11 flows from the injection well 7, permeates through the depleted zone 12 substantially uneventfully until it encounters the high temperature petroleum coke zone 13. The oxygen in the oxidant 11 rapidly reacts with excess hot petroleum coke 13 to produce primarily carbon monoxide and hydrogen. The resulting high temperature gas stream permeates the petroleum coke zone 13 and encounters bitumen in the leading edge of the bitumen production zone 14, which initiates endothermic coking reactions that maintain a well defined petroleum coke zone 13 that progressively moves from the oxidant injection well 7 to the vertical leg of the production well 8. The endothermic coking reactions temper the gas, thus providing an appropriate medium to heat the bitumen within the bitumen production zone 14, decreasing its viscosity, and facilitating bitumen flow to the underlying production well 8. Then, the fuel gas 15, that was produced in the bitumen production zone 14, serves as the motive flue for a gas lift within the vertical leg of the production well 8 to transport the well product 9 to a conventional gas-solid-liquid separator 16 that segregates the well product 9 stream into the fuel gas 15, bitumen 17, water 18, and sand 19 product streams.

Figure 2:
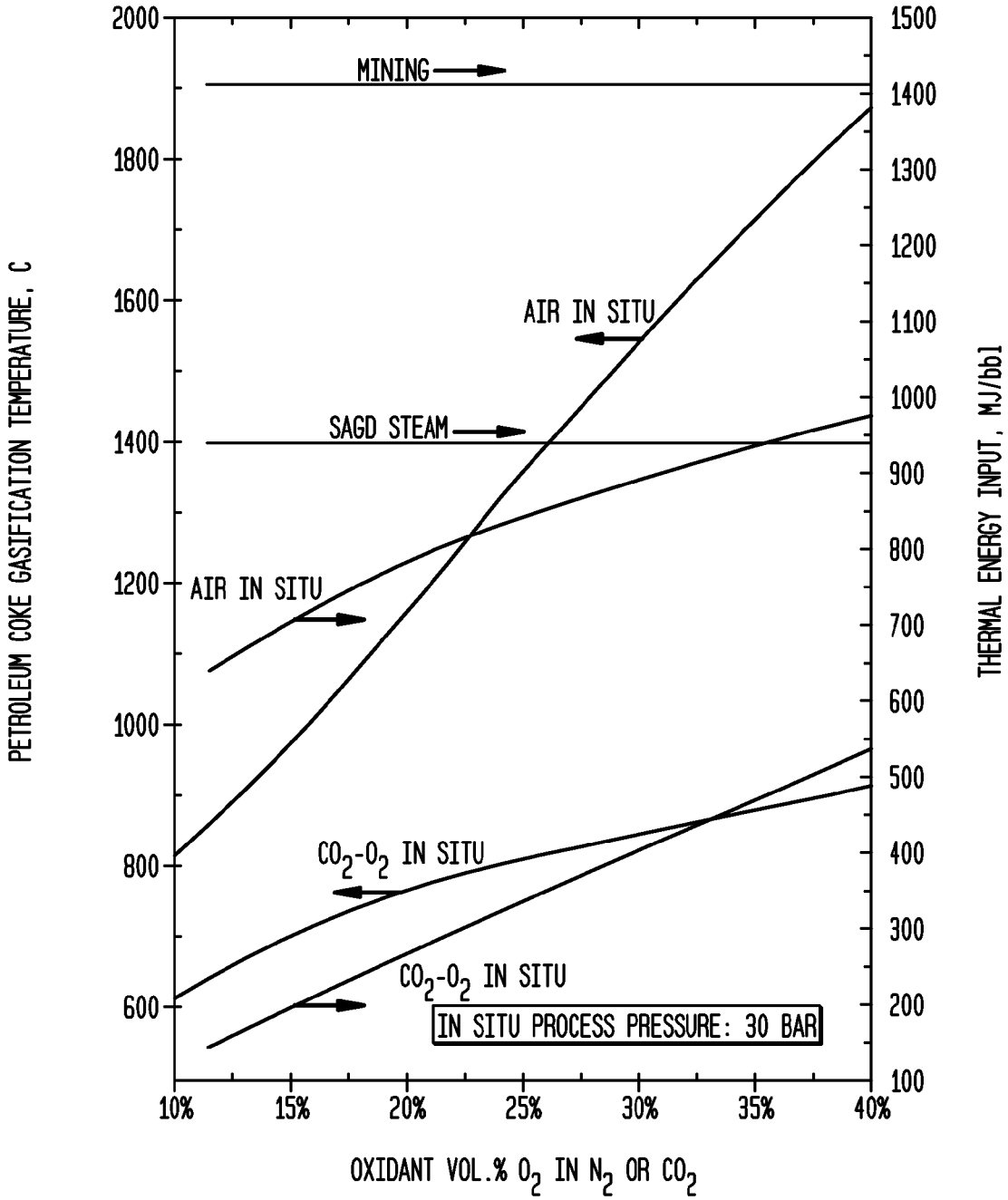
FIG. 2 is a plot of the effect of the oxidant oxygen content on the petroleum coke gasification temperature and the bitumen production thermal energy input requirement.

For convenience, safety, and process reasons, nitrogen is typically used as the primary diluent in the oxidant 11. FIG. 2 shows the effects of oxygen concentration and diluent type on the petroleum coke gasification temperature (left ordinate axis). The carbon dioxide diluent substantially reduces the temperature rise associated with higher oxygen concentrations via the endothermic reverse Boudouard reaction: $CO_2(g)+C(s) \rightleftharpoons 2CO(g)$ $\Delta H=-172$ KJ/M. Additional petroleum coke is formed when the high temperature and CO-rich gas from the petroleum coke zone 13 first contacts bitumen in the bitumen production zone 14. The carbon dioxide diluent is more effective than nitrogen in the bitumen production zone 14 for three reasons. First, carbon dioxide can heat the bitumen production zone 14 more effectively because it has a higher heat capacity than nitrogen. Second, essentially all the chemical energy stored in the CO product from petroleum coke gasification is released as thermal energy into the bitumen production zone 14 via the exothermic Boudouard reaction: $2CO(g) \rightleftharpoons CO_2(g)+C(s)$ $\Delta H=172$ KJ/M. Third, and most importantly, carbon dioxide miscibility in bitumen substantially decreases the bitumen viscosity, which dramatically decreases the energy required for bitumen production.

FIG. 2 also summarizes the thermal energy input requirement (right ordinate axis) for bitumen production using the leading bitumen production processes. The first point to be made is that mining has a much higher energy input requirement than any of the in situ bitumen production processes. The SAGD bitumen production process only uses steam heating to enhance bitumen production. The air in situ bitumen production process uses the combination of the heat of combustion and modest carbon dioxide partial pressure to reduce the energy input requirement by about 15% relative to the SAGD process. The carbon dioxide-oxygen combustion in situ bitumen process decreases the required thermal energy input by 65% to 82% relative to SAGD, depending on the oxidant oxygen concentration, by increasing the carbon dioxide partial pressure. Clearly, the preferred oxidant diluent is carbon dioxide. The preferred oxidant pressure and $O_2$ concentration ranges are 10 to 50 bar and 10 to 40 molar percent, more preferably 20 to 40 bar and 15 to 30 molar percent.

Figure 3:
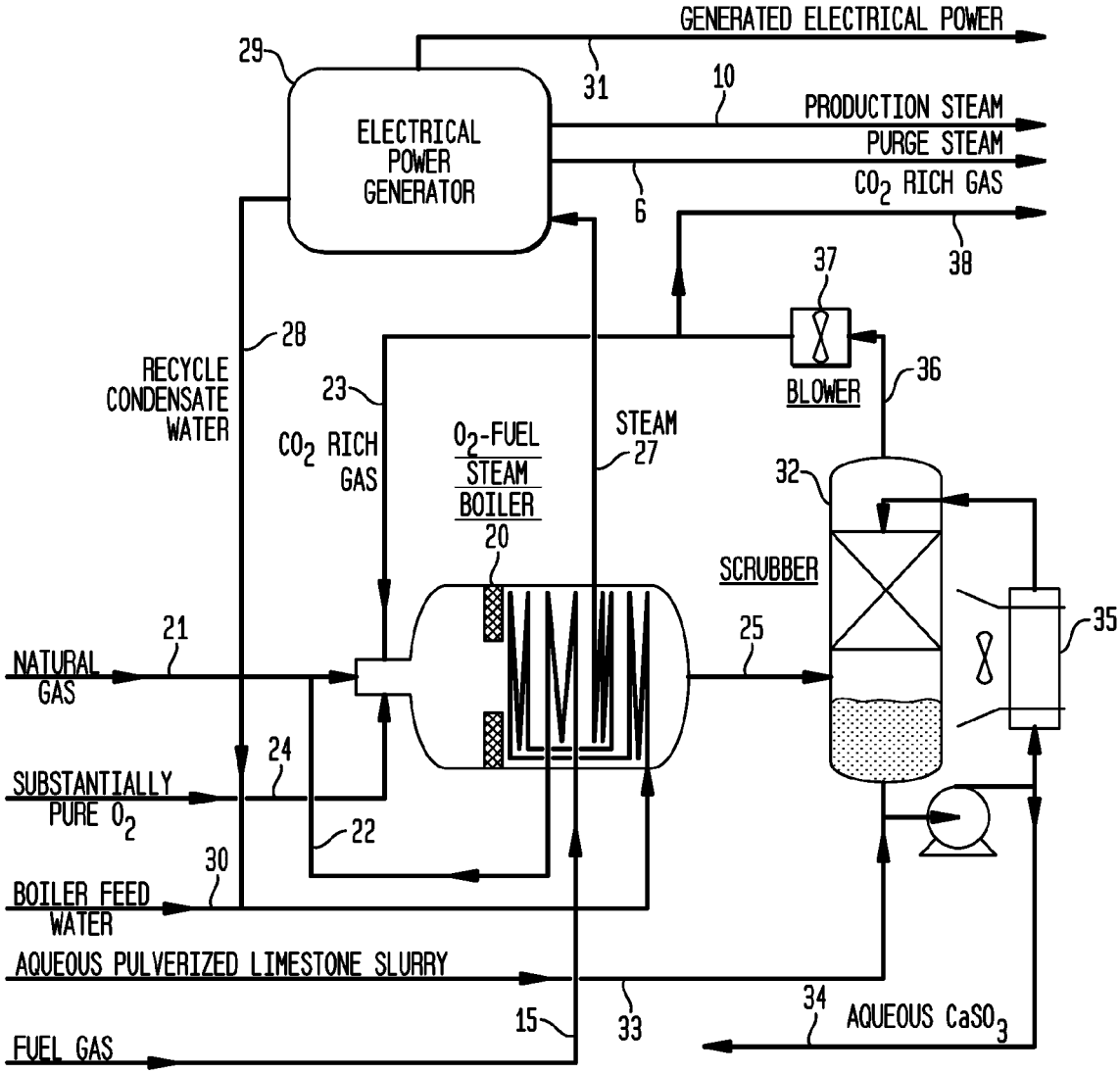
FIG. 3 illustrates a typical oxygen combustor and electrical power generation system.

FIG. 3 illustrates a typical oxygen combustor and electrical power generation system that can be used to produce a $CO_2$ rich gas stream 38 that serves as a key constituent for an oxidant 11 with the preferred $CO_2$ diluent. Since a substantial portion of the carbon monoxide and hydrogen that were produced by the petroleum coke gasification reactions in the bitumen bearing zone 1 are converted to carbon dioxide and water in the bitumen production zone 14, the gaseous hydrocarbon products, primarily methane, from the bitumen coking reactions are the primary fuel components in the fuel gas 15. The fuel gas 15 calorific value increases from about 1.6 to about 6 $MJ/Nm^3$ as the oxygen content of the oxidant 11 is increased from 10 to 40 molar percent. For reference, natural gas typically has a heating value of about 40 $MJ/Nm^3$. The fuel gas 15 is preheated in the $O_2$-fuel steam boiler 20. Natural gas 21 may be advantageously added to the preheated fuel gas 22 to maintain a reasonable combustion temperature when the fuel gas 15 heating value is less than about 3 $MJ/Nm^3$. Recycle $CO_2$ rich gas 23 may be used to limit the combustion flame temperature when the fuel gas heating value is substantially greater than 3 $MJ/Nm^2$.

The substantially pure oxygen feed 24 feed rate is set such that the oxygen content in the $O_2$-fuel steam boiler 20 off-gas 25 is greater than about 1 molar percent. Substantially pure $O_2$ preferably has an $O_2$ content greater than 70 molar percent, more preferably greater than 90 molar percent, most preferably greater than 95 molar percent. The $O_2$-fuel steam boiler 20 produces high pressure steam 27 (typically about 60 bar) using recycle condensate water 28 from the conventional electrical power generator 29 and boiler feed water 30. The high pressure steam is used to produce electrical power 31 in the electrical power generator 29, purge steam 6 to remove non-condensable gases from the bitumen bearing zone 1, and production steam 10 to heat the production well 8 and the bitumen production zone 14 in the vicinity of the production well 8. Typically an aqueous scrubber 32 is used to temper and remove $SO_2$ from the $O_2$-fuel stream boiler 20 off-gas 25. Typically an aqueous limestone slurry 33 is used as the base to remove $SO_2$ from the $O_2$-fuel stream boiler 20 off-gas 25, which produces an aqueous $CaSO_3$ slurry by-product 34. Typically an air cooler 35 would be used to control the water content of the scrubber 32 off-gas 36. A blower 37 provides the motive force for the $CO_2$ rich gas recycle 23 feed to the $O_2$-fuel steam boiler 20 and the export $CO_2$ rich gas 38.

Figure 4:
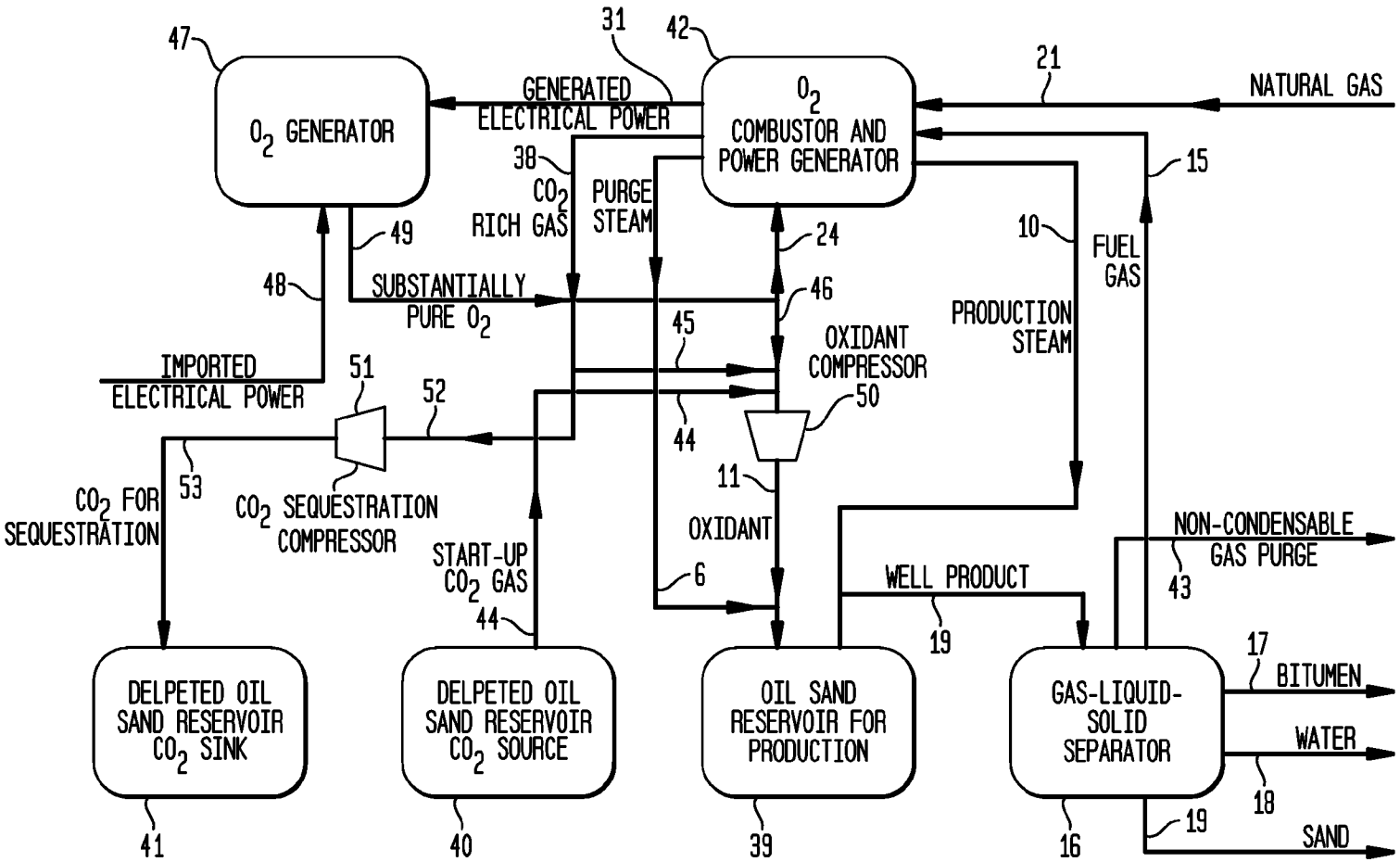
FIG. 4 is a block flow diagram that illustrates the in situ bitumen production method with carbon dioxide capture and sequestration.

FIG. 4 is a block flow diagram that will be used to illustrate the description of this in situ bitumen production method with carbon dioxide capture and sequestration. Block 39 represents an oil sand reservoir that is ready for bitumen production. Blocks 40 and 41 represent depleted oil sand reservoirs that are used as a $CO_2$ source and sink, respectively. These depleted oil sand reservoirs are used for both long-term underground $CO_2$ sequestration and short-term underground $CO_2$ storage to meet the periodic high $CO_2$ demand for well pair start-up. FIG. 4 illustrates the general features of Block 39, 40, and 41 with the understanding that the bitumen production zone 14 extends from the injection well 7 to the vertical member of the production well 8 in Block 39 and the bitumen depleted zone 12 extends from the injection well 7 to the vertical member of the production well 8 for the depleted oil sand reservoirs represented by Blocks 40 and 41.

The initial oil sand reservoir 39 start-up step is to use purge steam 6 to remove the non-condensable gases. The purge steam is produced by the $O_2$ combustor & power generator 42. FIG. 4 illustrates a typical configuration for the $O_2$ combustor & power generator 42. The non-condensable gases, primarily nitrogen, are purged from the oil sand reservoir for bitumen production 39 via the well product 19, gas-liquid-solid separator 16, and the non-condensable gas purge stream 43. Then, the oxidant 11 feed to the oil sand reservoir for production 39 is initially produced by blending start-up $CO_2$ gas 44 from depleted oil sand reservoir $CO_2$ source 40 and any excess $CO_2$ rich gas 45 from the $O_2$ combustor and power generator 42 with substantially pure $O_2$ 46 from a conventional cryogenic or pressure swing adsorption $O_2$ generator 47 to achieve the desired oxidant flow rate and $O_2$ content, typically in the 10 to 40 molar percent oxygen range. The oxidant flow rate is generally in the range of 1000 to 6500 $Nm^3/hr$ depending on the design of the well pair. Generally, some imported electrical energy 48 is required to meet the total substantially pure $O_2$ feed requirement 49. The oxidant compressor 50 increases the oxidant feed 11 to the desired pressure, typically in the range of 10 to 50 bar, preferably in the 20 to 40 bar range. The oxidant 11 is injected into the bitumen bearing zone 1, which produces the fuel gas 15, bitumen 17, water 18, and sand 19 products as described previously and illustrated in FIG. 1. The fuel gas 15 is fed to the $O_2$-fuel combustor and power generator 42 to produce electrical power 31, purge steam 6, production steam 10, and $CO_2$ rich gas 38 as described previously and illustrated in FIG. 3.

Figure 5:
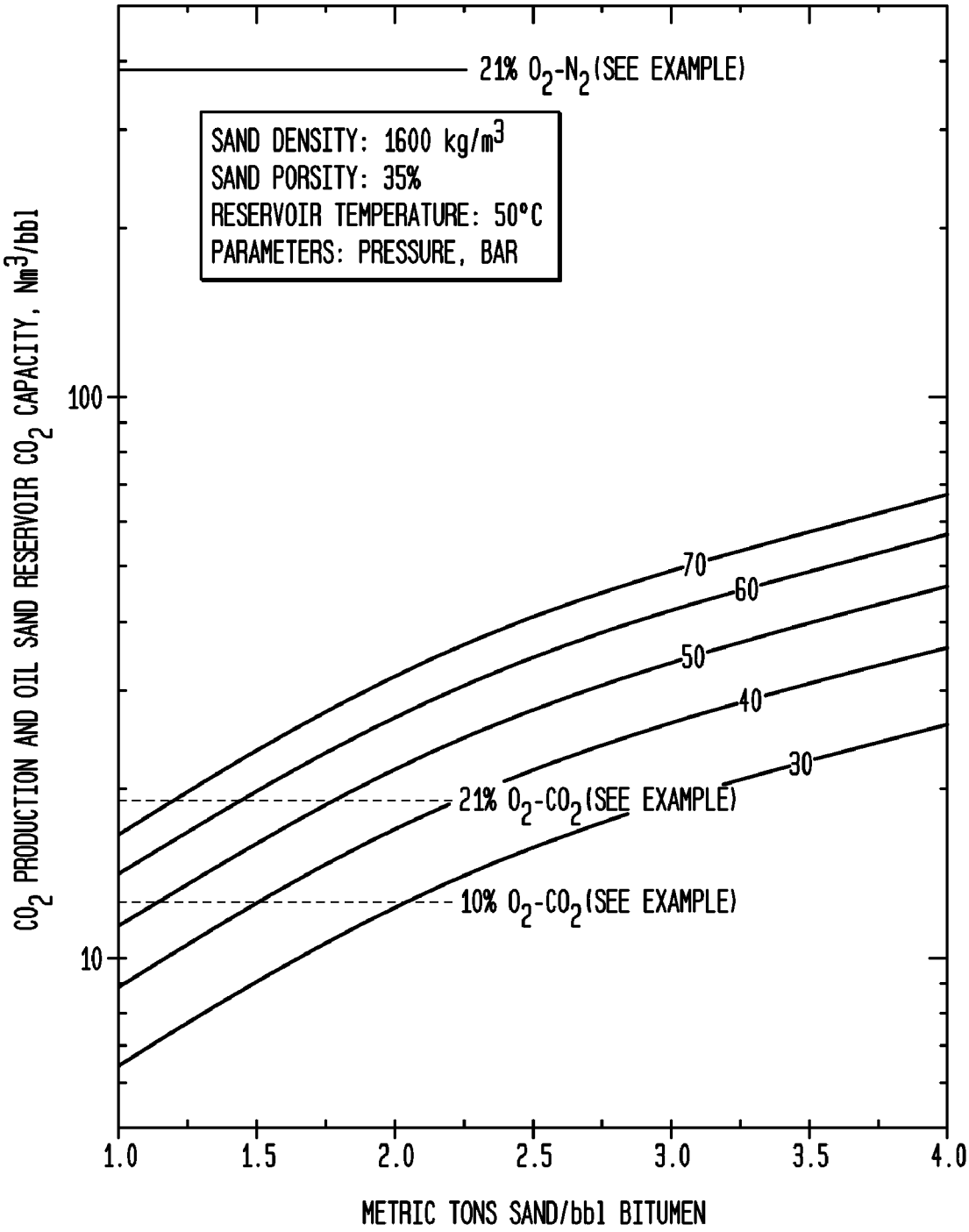
FIG. 5 summarizes the oil sand reservoir $CO_2$ production and sequestration capacity as a function of reservoir operating conditions properties.

The $CO_2$ sequestration compressor 51 compresses any excess $CO_2$ rich gas production 52 to produce a high pressure $CO_2$ 53 for sequestration in a depleted oil sand reservoir $CO_2$ sink 41 at a pressure between 30 and 70 bar, depending on the quantity of $CO_2$ produced and the nature of the oil sand reservoir. FIG. 5 illustrates a method to estimate the oil sand reservoir $CO_2$ capacity ($Nm^3$/bbl bitumen produced) as a function of the oil sand reservoir sand to bitumen ratio (MT/bbl) with parameters of sequestration pressure and the $CO_2$ for sequestration 53 ($Nm^3$/bbl bitumen produced) as a function of bitumen production operating conditions outlined in the Example. The reservoir $CO_2$ capacity must be a supermajority of the $CO_2$ produced for sequestration, preferably greater than 66%, more preferably greater than 80%, most preferably greater than or equal to 100%. If the $CO_2$ produced for sequestration is greater than the oil sand reservoir capacity, then the excess $CO_2$ produced can be sequestered in a supplemental $CO_2$ sequestration reservoir.

Example

The example will summarize the key operating conditions and performance indicators for the system in FIG. 4 with oxidants 11 containing 21 molar percent $O_2$ with $CO_2$ and $N_2$ diluents and a 10 molar percent $O_2$ oxidant with a $CO_2$ diluent. A conventional cryogenic $O_2$ generator 47 produced a 95 molar percent molar oxygen substantially pure oxygen 49 feed stream with argon as the major impurity. The $O_2$-fuel steam boiler 20 was operated with a 1500° C. flame temperature and produced high pressure steam at 482° C. and 61.7 bar for all cases. The natural gas 21 lower heating value was 37 $MJ/Nm^3$ for all cases. The production steam 10 flow rate was 200 kilograms per hour per well pair for all cases. The oxidant 11 pressure was 35 bar and flow rate was 2500 $Nm^3$ per hour per well pair for all cases. A number of parameters can be used to evaluate the performance of the 21% $O_2$ in $CO_2$, 21% $O_2$ in $N_2$, and 10% $O_2$ in $CO_2$ oxidants. For example, oxidant feed rates were 82.3, 220, and 87.5 $Nm^3$/bbl, respectively, which indicates that the $CO_2$ diluent very effectively increases the bitumen production. The fuel gas 15 lower heating values were 3.1, 3.0, and 1.9 $MJ/Nm^3$, which indicates that fuel gas heating value increases with oxidant $O_2$ concentration and is a weak function of the diluent type. The fuel gas 15 energy contents were 255, 660, and 140 MJ/bbl, respectively. The natural gas feed energy contents were 2, 690, and 145 MJ/bbl, respectively. The net electrical energy requirements were 6.7, −0.2, and 4.0 KW-hr/bbl, respectively. Most importantly, the $CO_2$ rich gas for sequestration 53 specific flow rates were 19, 380, and 12.5 $Nm^3$/bbl, which indicates, based in FIG. 5, that sand to bitumen ratios of about 1.75 and 2.5 MT/bbl would be required to sequester all the $CO_2$ rich gas for sequestration 53 with the sequestration pressure equal to the operating pressure of 35 bar for the 10% and 21% $O_2$ in $CO_2$ oxidants. This sand to bitumen ratio range is within the normal range found in oil sand reservoirs. Clearly, the $CO_2$ rich gas for sequestration 53 specific flow rate of 380 $Nm^3$/bbl for the air based in situ bitumen production process is well outside of the practical range.

While this invention has been described with respect to particular embodiments thereof, it is apparent that numerous other forms and modifications of the invention will be obvious to those skilled in the art. The appended claims in this invention should be construed to cover all such obvious forms and modifications which are within the true spirit and scope of the invention.

Having thus described the invention, what we claim is:

1. A method of in situ bitumen or heavy oil production comprising a) purging non-condensable gases from an oil sand reservoir with steam; b) contacting a gaseous oxidant stream with bitumen in an oil sand reservoir; c) separating a production well product from the oil sand reservoir into bitumen, water, sand, and fuel gas streams; d) producing a carbon dioxide rich gas by combustion of said fuel gas with substantially pure oxygen having an oxygen content greater than 70 molar percent; e) blending substantially pure oxygen having an oxygen content greater than 70 molar percent and a portion of said carbon dioxide rich gas as constituents of said gaseous oxidant stream; and f) sequestering a balance of the said carbon dioxide rich gas into a depleted oil sand reservoir.

2. The method as claimed in claim 1 wherein said production is continuous.

3. The method as claimed in claim 1 wherein said gaseous oxidant stream comprises oxygen, carbon dioxide and steam.

4. The method as claimed in claim 1 wherein said purge steam is produced by an oxygen combustor.

5. The method as claimed in claim 1 wherein said supermajority of the balance of the said carbon dioxide rich gas for sequestration in a depleted oil sand reservoir is greater than 66%.

6. The method as claimed in claim 1 wherein said contact in step a) is by injection.

7. The method as claimed in claim 1 wherein said gaseous oxidant stream contains from 10 to 40 molar percent oxygen.

8. The method as claimed in claim 1 wherein said gaseous oxidant stream is at a flow rate of 1000 to 5400 $Nm^3$/hour.

9. The method as claimed in claim 1 wherein said gaseous oxidant stream is at a pressure in the range of 10 to 50 bar.

10. The method as claimed in claim 1 wherein said contacting in step b) is by injection.

* * * * *